US006220729B1

(12) United States Patent
Holten

(10) Patent No.: US 6,220,729 B1
(45) Date of Patent: Apr. 24, 2001

(54) LUMINAIRE

(75) Inventor: Petrus A. J. Holten, Winterswijk (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/313,036

(22) Filed: May 17, 1999

(30) Foreign Application Priority Data

May 19, 1998 (EP) ..... 98201662

(51) Int. Cl.[7] ..... F21V 11/02
(52) U.S. Cl. ..... 362/291; 362/342
(58) Field of Search ..... 362/290, 291, 362/342, 297, 346

(56) References Cited

U.S. PATENT DOCUMENTS

| | | | | |
|---|---|---|---|---|
| 4,539,628 | * | 9/1985 | Bartenbach | 362/291 X |
| 5,528,478 | * | 6/1996 | Degelmann | 362/342 X |
| 5,758,954 | | 6/1998 | Holten et al. | 362/291 |

* cited by examiner

*Primary Examiner*—Stephen Husar
(74) *Attorney, Agent, or Firm*—Dicran Halajian

(57) ABSTRACT

The luminaire comprises various flat, light-scattering lamellae (10) extending between elongated reflectors (1) having a longitudinal edge (2) in a luminous window (3). The lamellae (10) have a concave outer edge (12) in the luminous window (3) and a convex inner edge (11). Undesirable reflections are precluded by the convex inner edge (11), while screening of the electric lamp to be accommodated is maintained.

8 Claims, 5 Drawing Sheets

LUMINAIRE

BACKGROUND OF THE INVENTION

The invention relates to a luminaire comprising:

concave, elongated reflectors which are arranged so as to be essentially opposite and parallel to each other, and which reflectors limit, with a longitudinal edge, a luminous window;

means for accommodating an elongated electric lamp between the reflectors;

a plurality of flat, light-scattering lamellae between the reflectors, transverse to the reflectors and transverse to the luminous window, which lamellae have an inner edge and a concave outer edge in the luminous window.

Such a luminaire is known from U.S. Pat. No. 5,758,954.

In the known luminaire, the inner edge of the lamellae is straight, so that, near the reflectors, the lamellae exhibit a greater height dimension, i.e. a larger distance from the inner edge to the outer edge, than centrally between the reflectors.

The reflectors do not only focus the light generated by a lamp accommodated in the luminaire but also screen the lamp in a direction transverse to the lamp, and in directions surrounding said direction, so that the lamp can only be observed through the longitudinal edges of the reflectors, see FIG. 2*a*, outside a selected angle $\alpha$ made with a plane Q. In the longitudinal direction of the lamp, and in directions surrounding said direction, the lamellae have a screening effect, so that, also in the longitudinal direction of the lamp, the lamp can only be observed outside an angle made with plane Q. In this manner, the reflectors and the lamellae preclude glare if the luminaire is observed at relatively large angles with the normal to plane Q. This screening effect is also necessary to prevent disturbing reflections, for example at display screens. Screening is efficient if there is a screening effect both in directions around the longitudinal direction of the lamp and in a direction transverse to the lamp at a substantially equal angle $\alpha$.

The above-mentioned document explains that for efficient screening, the lamellae must have a concave outer edge. In conventional lamellae, which do not only have a straight inner edge, but also a straight outer edge, screening in the longitudinal direction of the lamp is greater than in directions surrounding the longitudinal direction. If the screening effect in the longitudinal direction of the lamp is chosen to be equal to that in a direction transverse to the lamp, then the screening effect in directions around the longitudinal direction is too small and the standard for screening is not met in all directions. If this is precluded, for example by arranging the lamellae with a smaller interspace, then the screening effect in the central part of the lamellae is excessive, leading to a loss of light caused by additional reflections at the lamellae. This can be attributed to the fact that reflections are always accompanied by absorption.

The lamellae of the known luminaire may alternatively be three-dimensional bodies, for example folded from aluminium strip, which flare out from the outer edge to the inner edges. The inner edges of the lamellae may also be concave in order to preclude that, after reflection at the surfaces of the lamellae facing the lamp, bright images of the lamp are formed on the reflectors, which can be observed as disturbing bright spots from the angle $\alpha$ screened by the reflectors.

It is a drawback of the known luminaire having flat lamellae, that the lamellae cause undesirable reflections and unnecessary loss of light.

In DE-U-7613194 a description is given of a luminaire in which the flat lamellae have a largely convex outer edge and a largely concave inner edge. The known, above-described drawback of lamellae having a straight outer edge, i.e. inefficient or insufficient screening, applies to a greater extent to these lamellae.

SUMMARY OF THE INVENTION

It is an object of the invention to provide a luminaire in which undesirable reflections at the lamellae are reduced.

This object is achieved, in accordance with the invention, in that the inner edge of the lamellae is convex.

This measure has various consequences.

As a result of the convex shape of the inner edge of the lamellae, the lamellae are less voluminous than they would be if they had a straight inner edge. As a result, fewer light rays are intercepted on their way to the reflectors and fewer reflections, which lead to a loss of light due to absorption, occur. The convex shape of the inner edge has no consequences for the screening of the lamp in its longitudinal direction and in directions surrounding the longitudinal direction, because for screening, apart from the entire outer edge of the lamellae, only the center of the inner edge is important.

Due to the thickness of lamellae, light which, in the case of lamellae having a straight inner edge, falls on the lamellae close to the reflectors, is cast onto the reflectors, which reflect the light in such a way that it leaves the luminaire and lands within the angle $\alpha$ screened by the reflectors. In accordance with the opening paragraph of the above-cited document, this is precluded by providing the lamellae with an inner edge which is concave in shape. These reflections are particularly disturbing in known lamellae which have a three-dimensional shape and which, as described above, have a greater thickness dimension near the inner edge than near the outer edge, particularly if the lamellae are made of a reflecting or semi-mat material. The occurrence of disturbing light within the angle $\alpha$ screened by the reflectors, which has already been reduced by using flat lamellae, is further suppressed by the measure in accordance with the invention.

In the case of these solid lamellae, the smaller volume of the lamellae with a convex inner edge also leads to a smaller material content. This is an important aspect regarding the cost price of the luminaire. If the lamellae are manufactured by cutting, for example punching, them from strip material, then the convex inner edge of the lamellae causes the amount of waste material to be reduced.

In a favorable embodiment, the inner edge and the outer edge of the lamellae are essentially parallel. In this case, there is no waste material and the formation of the outer edge of a first lamella results in the formation of the inner edge of a second lamella. However, while maintaining a proper screening of the lamp to be accommodated in the luminaire, the convexity given to the inner edge may exceed the concavity given to the outer edge. In this case, the lamellae become narrower in the direction from the center to the reflectors. The inner edge narrows towards the outer edge. These lamellae, which are even less voluminous, have the advantage that they cause even fewer interceptions and hence fewer reflections.

The lamellae may be made, for example, of a metal and may, or may not, be painted white or another color. They may be provided, for example, with decorative perforations. Unpainted lamellae may be mat or semi-mat. The lamellae may alternatively be made of a translucent synthetic resin which passes light in a scattering manner or of a non-translucent synthetic resin which may or may not be colored.

If highly reflective flat lamellae were to be used, then they would show mirror images of the accommodated lamp and, since they are flat and do not deflect incident light, they would still cast concentrated light in the screened angle, which might cause glare.

Particularly near the inner edge, the flat, scattering lamellae of luminaires may still exhibit a relatively high brightness. In a particular embodiment of the luminaire in accordance with the invention, the lamellae have profiled surfaces. For example, they may comprise folds with an amplitude which extend along the outer edge. As a result, an observer sees alternate zones of relatively high and relatively low brightness on the surface of the lamellae, where light is deflected, respectively, towards and away from an observer, so that the lamellae as a whole have an average brightness which is lower than the brightness of unfolded lamellae.

In a modification of this embodiment, the amplitude of the folds decreases towards the outer edge. In this manner, it is achieved that the brightness of the lamellae is further equalized in a direction from the outer edge to the inner edge.

The profiled surfaces may alternatively have been formed by providing the lamellae with, for example spherical, dents. At the other surface, these dents manifest themselves as bulges. Each of the two surfaces may have both dents and bulges. Dents and bulges may each be arranged in groups, but favorably they alternate with each other. In this case, a dent is surrounded by bulges.

In a modification, the depth of the dents and hence the height of the bulges decreases towards the outer edge. In another modification, their mutual distance decreases towards the outer edge.

In various types of luminaires, the lamellae are inextricably connected to the reflectors in that they are passed through slits in the reflectors and are subsequently fixed, for example by bending them behind the reflectors.

For luminaires of this construction it is attractive if the profile, the folds or the dents extend(s) exclusively between the reflectors. In this case, a substantially lighttight connection of the lamellae to the reflectors can be readily achieved, while these reflectors comprise slits with straight edges which are easy to make.

An attractive property of profiled, for example folded, lamellae is that in the manufacturing process they can be made, for example from metal strip, cut and profiled in a single process step. A top of a fold or a dent at one surface of the lamella is a pit at the other surface of the lamella.

The luminaire may be used, for example, for accommodating a straight, tubular electric lamp, for example a fluorescent lamp such as a low-pressure mercury vapor discharge lamp. The luminaire may alternatively be used for an elongated lamp, comprising, for example, two straight, interconnected tubular parts extending next to each other.

The luminaire may, or may not, comprise a housing accommodating the reflectors.

DETAILED DESCRIPTION OF THE PREFERRED EMBODIMENTS

Figure 1:
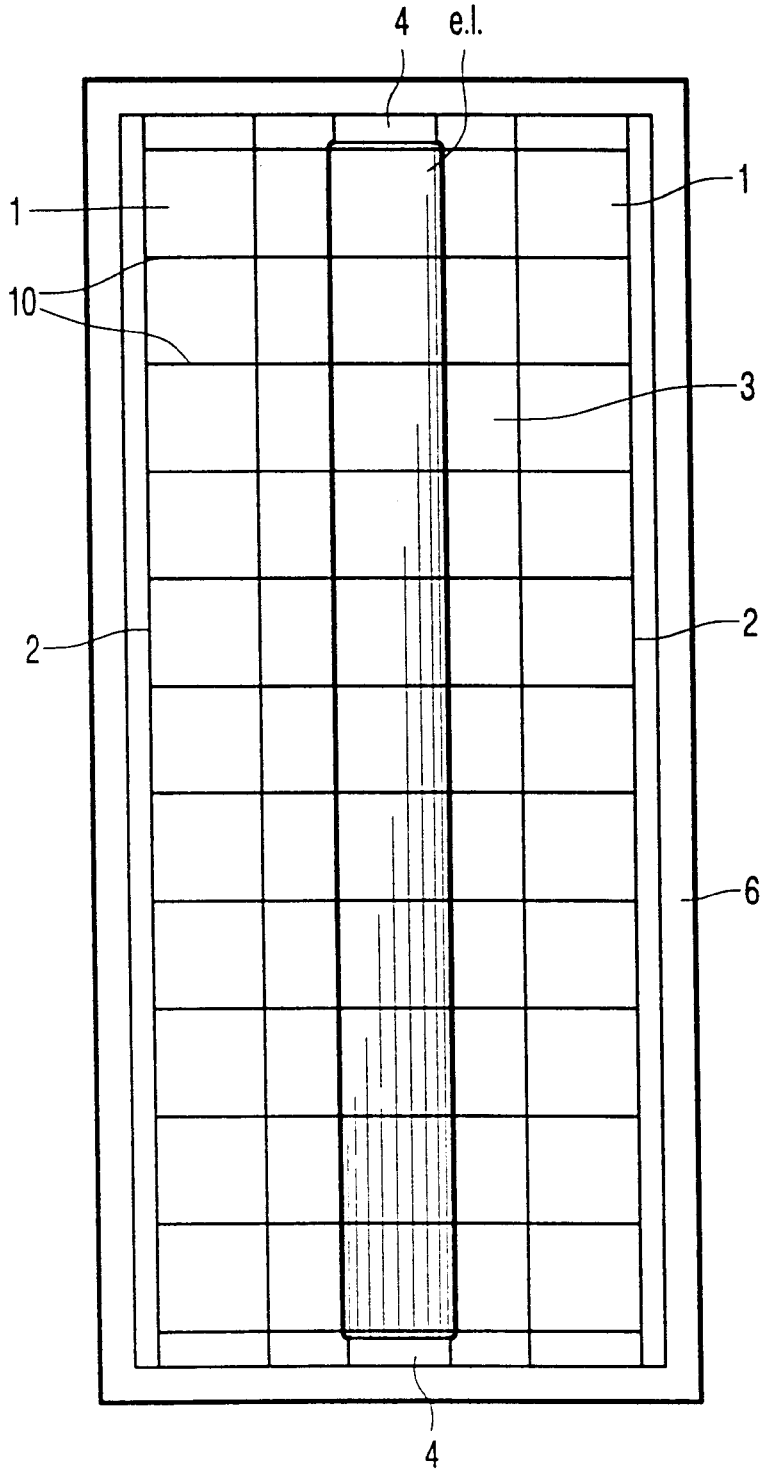
FIG. 1 is a view of the luminaire co rising the luminous window.
Figure 2A:
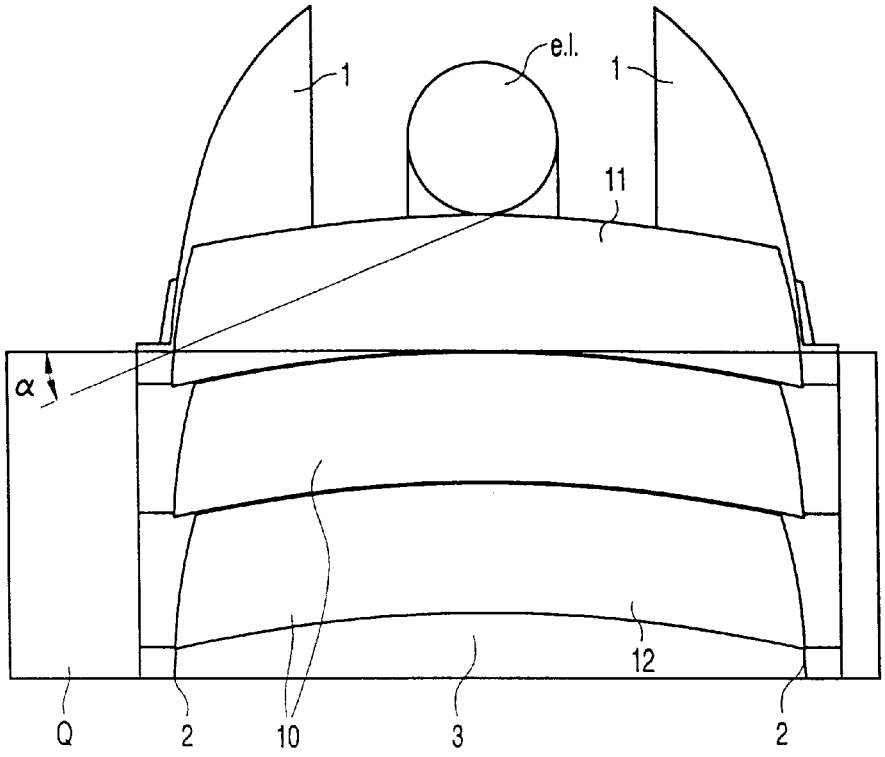
FIG. 2*a* is a perspective view of a part of the luminaire shown in FIG. 1, viewed in a plane through the lamp and perpendicularly to the luminous window.
Figures 3A, 3B:
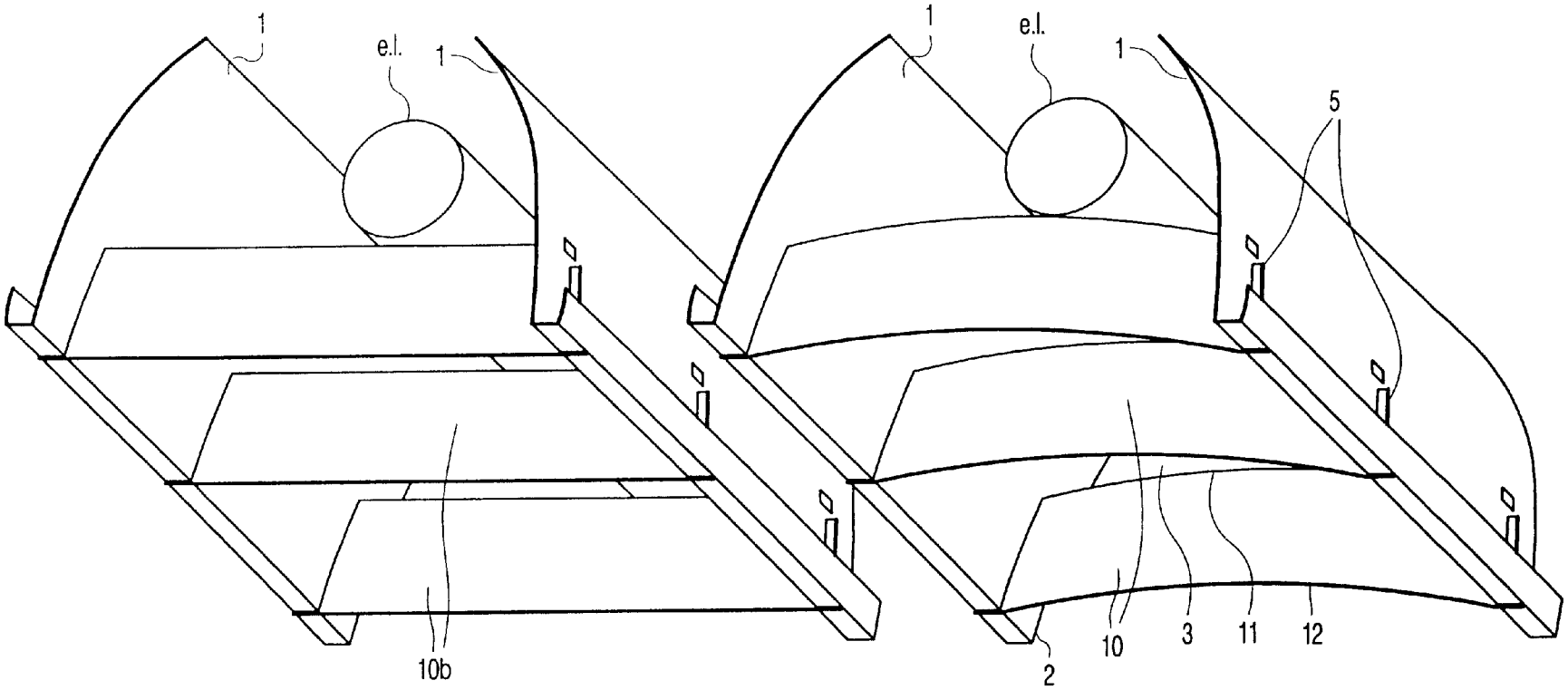
FIG. 3b (PRIOR ART)
FIG. 3*a* is a perspective view of a part of the luminaire shown in FIG. 1, viewed in a plane extending obliquely to the lamp.
FIG. 3*b* is a similar representation of the conventional luminaire shown in FIG. 2*b;*

The luminaire shown in FIG. 1, also see FIGS. 2*a* and 3*a*, comprises concave, elongated reflectors 1 which are placed opposite each other so as to be essentially parallel, which reflectors limit, with a longitudinal edge 2, a luminous window 3. In FIG. 1, the reflectors 1 are accommodated in a housing 6. Means 4 are available for accommodating an elongated electric lamp e.1 in said housing, between the reflectors. A plurality of flat, light-scattering lamellae 10 is provided between the reflectors 1, which extend transversely to the reflectors 1 and to the luminous window 3. Said lamellae 10 have an inner edge 11, which extends along the luminous window, at a distance from said window, and a concave outer edge 12 in the luminous window 3.

The inner edge 11 of the lamellae 10 is convex, see FIGS. 2*a* and 3*a*.

FIGS. 2*a* and 3*a* show that the inner edge 11 and the outer edge 12 of the lamellae 10 are essentially parallel.

Figure 2B:
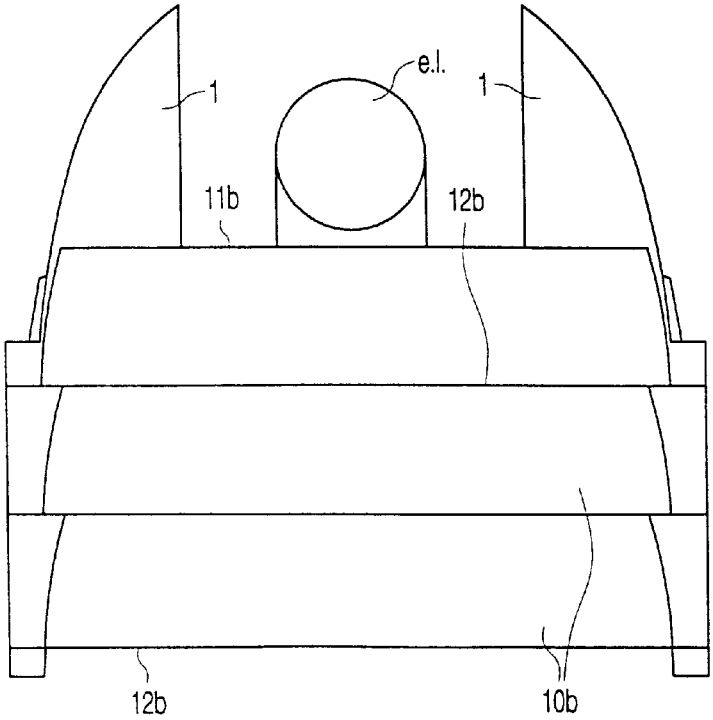
FIG. 2b (PRIOR ART)
FIG. 2*b* is a similar representation of a conventional luminaire.

FIG. 2*a*, comprising lamellae 10 of the luminaire in accordance with the invention, and FIG. 2*b*, comprising conventional lamellae 10*b* having straight inner edges 11*b* and outer edges 12*b*, respectively, are represented, relative to an observer standing in line with the luminaires and looking up at the luminaires, at an angle with the lamp such that the lamellae 10, 10*b* just fully screen the lamp. The Figures thus depict the luminaires at the bounds of the area screened by the lamellae 10*a*, 10*b*. If the observer would take a step in the direction of the luminaires, he would be able to see the lamp in both luminaires because he enters the unscreened area. The screening angle is the same for both luminaires, for example 30°.

FIGS. 3*a* and 3*b* show the same luminaires as they are seen by the observer after he has taken a step to the right. In FIG. 3*a*, the lamellae 10 still screen the entire lamp with the concave outer edge 12: in the oblique plane of collimation, the screening effect produced by the lamellae 10 is still the same. In FIG. 3*b*, however, the lamp is visible between the lamellae 10*b*. In the indicated direction, the lamellae 10*b* provide insufficient screening. As this is impermissible, the height of the lamellae 10*b* must be increased or the spacing between them must be reduced. In the position shown in FIG. 2*b*, this new geometry however leads to excessive screening and hence loss of light.

FIG. 3*a* also clearly shows that the convex inner edge 11 of the lamellae 10 does not have an adverse influence on the screening effect. In the direction of the reflectors 1, the inner edge 11 may also narrow towards the concave outer edge 12 without exerting an adverse influence on the screening effect.

Figure 4:
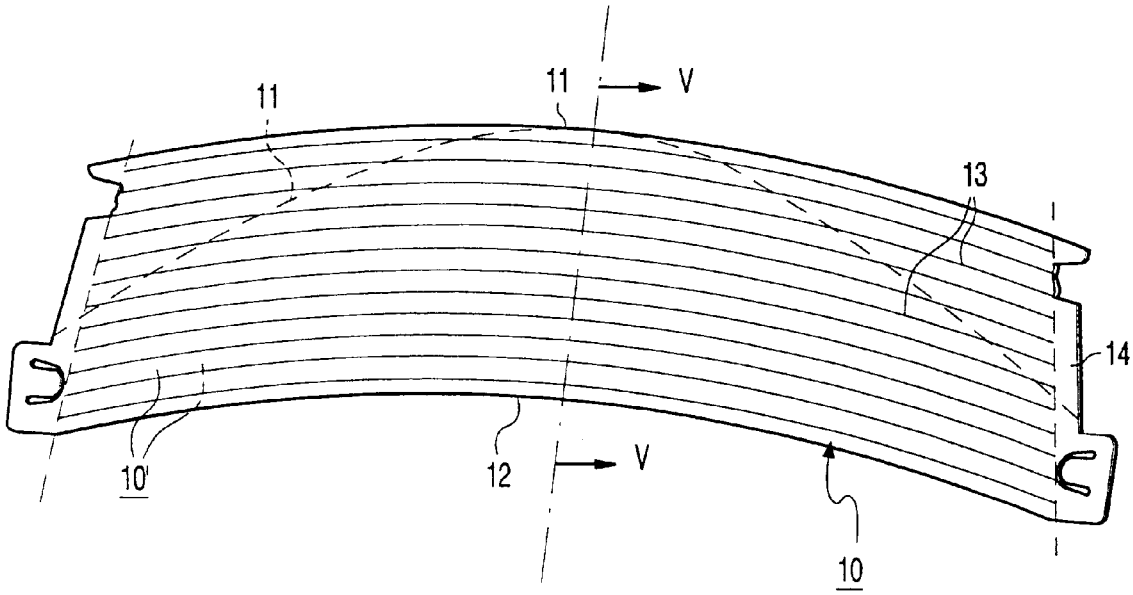
FIG. 4 is a view of a profiled lamella.
Figure 5:
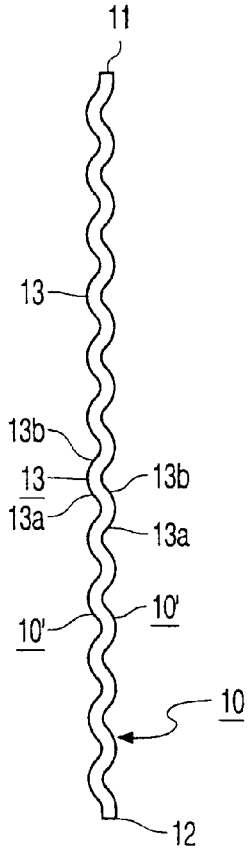
FIG. 5 shows the plane of intersection of the sectional view taken on the line V—V in FIG. 4.

In FIG. 4, the lamellae 10 have profiled surfaces 10'; in this Figure surfaces 10' having folds 13 with an amplitude extending along the outer edge 12. As shown in FIG. 5, the amplitude is constant throughout the height of the lamellae 10. With respect to an observer standing beneath the Figure, the folds 13 have a part 13*a* facing said observer, and a part 13*b* facing away from the observer, which parts have, respectively, a relatively low and a relatively high brightness when an accommodated lamp burns. The folds 13 provide the lamellae 10 as a whole with a brightness which, on average, is relatively low compared to an unfolded lamella.

FIGS. 3*a* shows that the lamellae 10 project from slits 5 in the reflectors 1 and are fixed in said slits. FIG. 4 shows that the folds 13, the profiled parts of the surfaces 10', extend only between the reflectors 1. Parts 14 of the lamellae 10, which are inserted in and project from the slits 5 are not folded.

FIG. 4 also shows, by means of a dashed line, an alternative lamella, the inner edge 11 of which narrows, in the direction of the reflectors, towards the outer edge 12.

Figure 6:
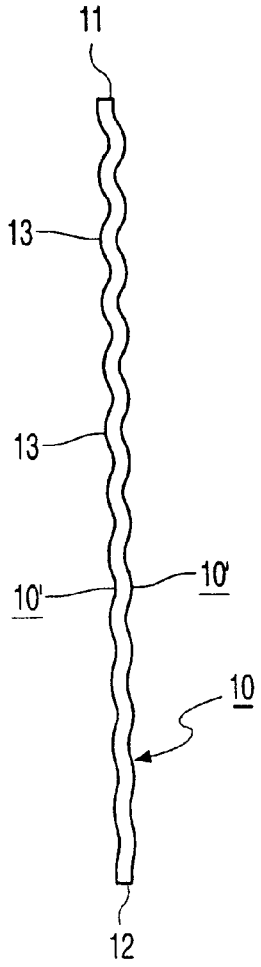
FIG. 6 is a variant of FIG. 5.

In the embodiment shown in FIG. 6, the amplitude of the folds 13 decreases towards the outer edge 12. As a result, the brightness in a zone bordering on the inner edge 11 differs little, or not at all, from that at the outer edge 12.

Figure 7:
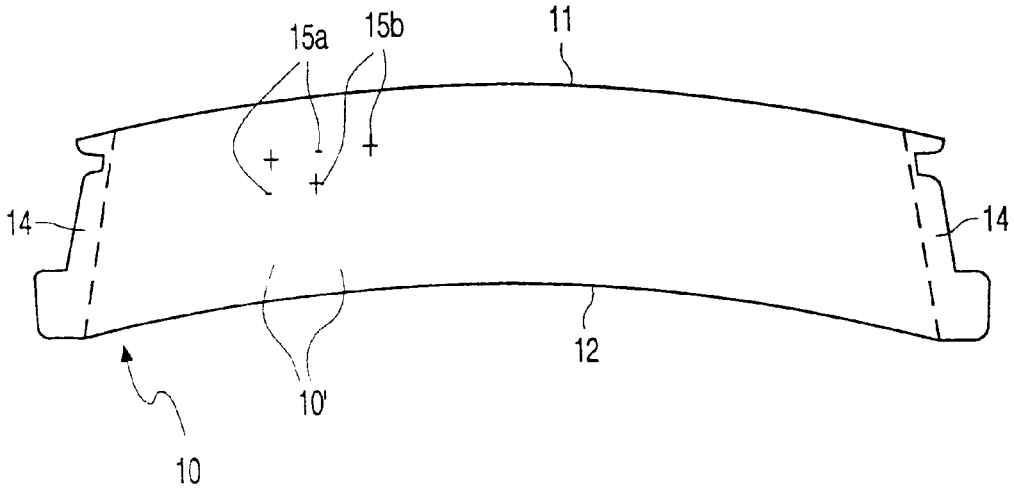
FIG. 7 is a view of a different embodiment of a profiled lamella.

FIG. 7 shows the profiled lamella 10, which is provided with alternate dents 15*a* and bulges 15*b*.

What is claimed is:

1. A luminaire comprising:

reflectors which are arranged opposite and parallel to each other, wherein said reflectors are concave and elongated, said reflectors having a longitudinal edge that limits a luminous window;

means for accommodating an elongated electric lamp between the reflectors;

a plurality of lamellae between the reflectors, said plurality of lamellae being flat and light-scattering and being transverse to the reflectors and transverse to the luminous window, wherein said plurality of lamellae each have an inner edge and a concave outer edge in the luminous window, wherein the inner edge is convex.

2. A luminaire as claimed in claim 1, wherein the inner edge and the concave outer edge of at least one of said plurality of the lamellae are essentially parallel.

3. A luminaire as claimed in claim 1, wherein, in a direction of the reflectors, the inner edge narrows towards the concave outer edge.

4. A luminaire as claimed in claim 1, wherein the plurality of lamellae have profiled surfaces.

5. A luminaire as claimed in claim 4, wherein the plurality of lamellae comprises folds with an amplitude, which extend along the concave outer edge.

6. A luminaire as claimed in claim 5, wherein the amplitude of the folds decreases towards the concave outer edge.

7. A luminaire as claimed in claim 4, wherein the profiled surfaces have dents and bulges.

8. A luminaire as claimed in claim 4, wherein the plurality of lamellae projects from slits in the reflectors and is fixed therein, and wherein the profiled surfaces are only present between the reflectors.

* * * * *